US005359339A

United States Patent [19]

Agrawal et al.

[11] Patent Number: 5,359,339

[45] Date of Patent: Oct. 25, 1994

[54] BROADBAND SHORT-HORN ANTENNA

[75] Inventors: Ashok K. Agrawal, Mount Laurel; Michael S. Perry, Haddonfield; Norman R. Landry, Mount Laurel, all of N.J.

[73] Assignee: Martin Marietta Corporation, Moorestown, N.J.

[21] Appl. No.: 92,645

[22] Filed: Jul. 16, 1993

[51] Int. Cl.[5] ..... H01Q 13/00

[52] U.S. Cl. ..... 343/786; 333/26; 333/248

[58] Field of Search ..... 343/771, 772, 786; 333/26, 239, 248; H01Q 13/00

[56] References Cited

U.S. PATENT DOCUMENTS

| | | | |
|---|---|---|---|
| 3,478,282 | 11/1969 | Smith | 333/248 |
| 4,500,887 | 2/1985 | Nester | 343/700 |
| 4,651,115 | 3/1987 | Wu | 333/26 |
| 4,737,970 | 4/1988 | Viola et al. | 375/106 |
| 4,755,828 | 7/1988 | Grim | 343/786 |
| 4,920,351 | 4/1990 | Bartlett et al. | 343/786 |
| 5,111,164 | 5/1992 | De Ronde | 333/248 |
| 5,122,390 | 6/1992 | Rearick et al. | 427/117 |
| 5,148,131 | 9/1992 | Amboss et al. | 333/26 |
| 5,227,744 | 7/1993 | Sabatier | 333/26 |

OTHER PUBLICATIONS

"Simulation of a Phased-Array Antenna In a Waveguide" by Hannan et al., pp. 342–353 of IEEE Transactions on Antennas and Propagation, May 1965.

*Primary Examiner*—Donald Hajec
*Assistant Examiner*—Tan Ho
*Attorney, Agent, or Firm*—William H. Meise; Carlos A. Nieves; Stephen A. Young

[57] ABSTRACT

A short horn antenna (10) adapted for array use includes a rectangular waveguide with broad upper (12) and lower (14) walls and narrow side walls (16, 18), defining a radiating aperture (20) and a feed end closed off by a shorting plate (22). A stepped upper ridge (26) has a slot (50) adjacent the shorting plate, and a shorter stepped lower ridge (46) has a corresponding slot. An unbalanced transmission line (75) extends through the shorting wall, and the smaller conductor (76) extends into the waveguide as an electric probe (60). The probe includes a first portion (64), extending parallel to the waveguide axis (8) and into the slot in the upper ridge. The probe (60) also includes a second portion (66) extending at an angle (90°) relative to the first portion (64) of the probe (60).

12 Claims, 8 Drawing Sheets

FIG. 8

WAVEGUIDE INTERIOR DIMENSIONS

| | | |
|---|---|---|
| LENGTH | $L_W$ | 0.970 inch |
| WIDTH | $W_W$ | 1.660 inch |
| DEPTH | $D_W$ | 0.460 inch |

UPPER RIDGE 26 DIMENSIONS

| | | | |
|---|---|---|---|
| TOTAL LENGTH | $L_R$ | 0.800 inch | |
| OVERALL WIDTH | $W_R$ | 0.250 inch | |
| OVERALL (STEP1) DEPTH | $D_{S1}$ | 0.175 inch | |
| STEP 2 DEPTH | $D_{S2}$ | 0.120 inch | |
| STEP 3 DEPTH | $D_{Se}$ | 0.080 inch | |
| STEP 1 LENGTH | $L_{RS1}$ | 0.400 inch | SLOT DEPTH $D_S > 0.210$ inch |
| STEP 2 LENGTH | $L_{RS2}$ | 0.200 inch | SLOT LENGTH $L_S$ 0.300 inch |
| STEP 3 LENGTH | $L_{RSE}$ | 0.200 inch | |

LOWER RIDGE 46 DIMENSIONS
(SAME AS UPPER RIDGE EXCEPT)

| | | |
|---|---|---|
| TOTAL LENGTH | $L_R$ | 0.700 inch |
| STEP 1 LENGTH | $L_{RS1}$ | 0.300 inch |

RIDGE POSITIONS

| | | |
|---|---|---|
| SETBACK/APERTURE | $L_{SB}$ | 0.065 inch |
| U. SPACING/SHORT-CIRC. | $L_{SF1}$ | 0.075 inch |
| L. SPACING/SHORT-CIRC. | $L_{SF2}$ | 0.175 inch |

PROBE 60

| | | |
|---|---|---|
| LENGTH / PORTION 64 | $\ell_{P1}$ | 0.360 inch |
| LENGTH / PORTION 66 | $\ell_{P2}$ | 0.358 inch |
| OUTER CONDUCTOR 414 | $D_O$ | 0.130 inch |
| PROBE DIAMETER | $D_C$ | 0.036 inch |

PROBE POSITION

| | | |
|---|---|---|
| PENETRATION/U. RIDGE | $L_{P1}$ | 0.130 inch |
| PENETRATION/L. RIDGE | $L_{P2}$ | FLUSH |
| DEPTH INTO L. RIDGE | $d_{P\ell}$ | 0.126 inch |

BROADBAND SHORT-HORN ANTENNA

This invention relates to antennas of the horn type, and more particularly to ridged horn antennas which are physically short and fed from the rear, so as to be adapted to use in an array.

BACKGROUND OF THE INVENTION

Planar arrays of printed elements are widely known, but may not be useful in some applications, such as radar, where high power must be handled. Also, planar arrays of printed elements tend to couple preferentially into the dielectric substrate, and if a dielectric antenna face plate is used, into the faceplate. Under some conditions of off-broadside radiation, total internal reflection can occur, which results in "blind angles" at which radiation does not take place. In addition, an external radome is required to protect a printed-circuit antenna from the external environment. In a harsh environment, some kind of heating mechanism has to be provided in order to prevent formation of ice on a radome surface. This heating requirement tends to make the design of such a radome difficult. For many radar systems, horn antenna arrays are preferred, because of their ruggedness, power-handling capability, and gain. In harsh environments, a dielectric window, preferably ceramic, is placed over the aperture of the horn to prevent ingress of corrosive precipitation and other matter into the horn cavity.

Horn antennas tend to be physically heavier than printed-circuit antennas, and are three-dimensional rather than two-dimensional. Making a large array of horn antenna elements can require a significant construction effort. Among the problems to be overcome are (a) mounting of the horns in close proximity to each other without interference; (b) assuring that the mounted horns have mutually parallel axes; (c) making the requisite connections at the back of the horn array; (d) making sure that the dielectric windows are sealed; and after the antenna is installed, the further problems arise of (e) gaining access to a particular horn of the array for maintenance or replacement; and (f) performing step (e) without allowing the ingress of corrosive precipitation or other matter. In addition to these physical considerations, high-performance antennas require a broad operating bandwidth, preferably a 2:1 frequency bandwidth.

One of the most difficult aspects of the design of a horn array is the requirement for impedance matching in the array environment over the scan volume. Whatever the bandwidth of interest, it is always more difficult to match the antennas in a controllable array to their respective feeds than it is to match an individual antenna alone. The problem arises because, when mounted in the array, each antenna element is subject to mutual coupling from the adjacent antenna elements, which varies in both amplitude and phase in response to beam steering. When the instantaneous bandwidth is large, as for example 2:1, impedance matching is even more difficult.

An improved horn element and array is desired.

SUMMARY OF THE INVENTION

A short horn antenna includes a short length of rectangular waveguide with a short-circuiting wall at the feed end. Ridges, including a stepped or tapered portion adjacent to, but not extending beyond the aperture, are supported by the broad walls of the waveguide. A dielectric window may cover the radiating aperture. In a preferred embodiment, the ridges are of different lengths, terminating at their feed ends at locations spaced away from the short-circuiting wall. A feed probe is supported by the short-circuiting wall, and includes a first portion extending into a slot in the upper ridge, and also includes a second portion extending from the end of the first portion of the probe, through the slot, generally toward the lower broad wall, and electrically (DC) isolated from both the upper and lower ridges. In one embodiment of the invention, an array includes a metallic wall into which the rectangular waveguides and ridges are machined. A movable common back wall supports the coupling probes associated with all the horn elements of the array, so that all the horns of an array (or a section thereof) may be simultaneously accessed from the rear for maintenance. The removable rear wall allows the dielectric windows to remain in place during maintenance of the array.

DESCRIPTION OF THE DRAWING

FIG. 8 tabulates dimensions of the horn of FIGS. 3*a*, 3*b* with probe of FIG. 4 for operation in the frequency range of 3.0 to 6.0 GHz;

DESCRIPTION OF THE INVENTION

Figure 1:
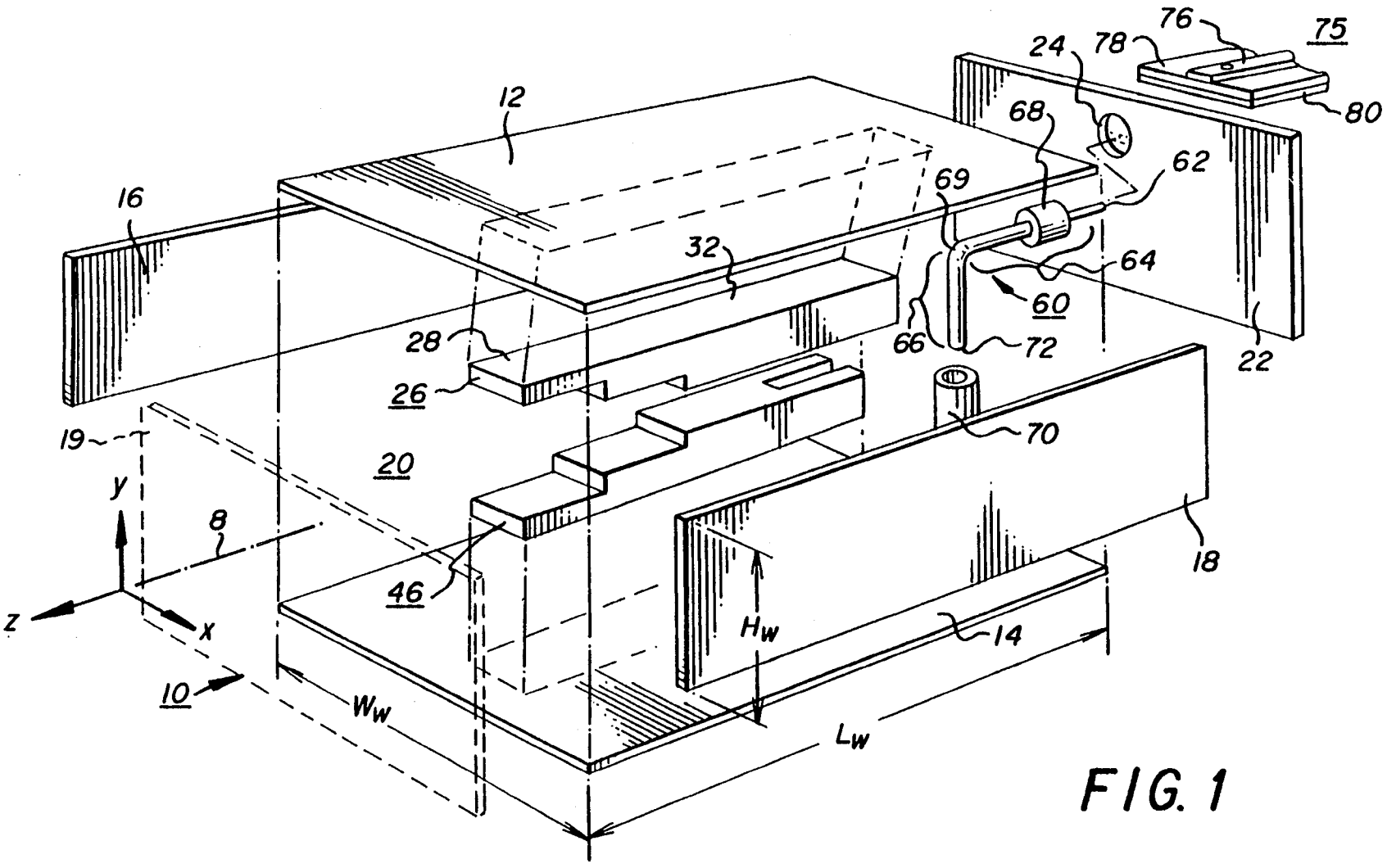
FIG. 1 is an exploded view of a horn antenna according to the invention, showing upper and lower ridges exploded away from waveguide walls.
Figure 2A:
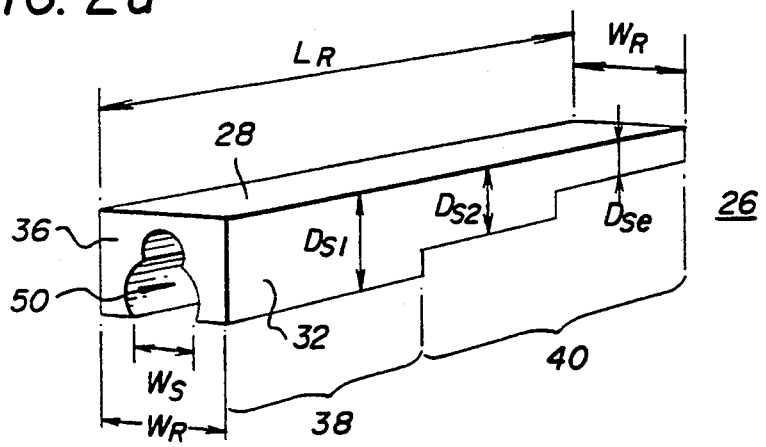
FIGS. 2*a* and 2*b* are top and bottom perspective or isometric views, respectively, of the upper ridge of FIG. 1.
Figure 2B:
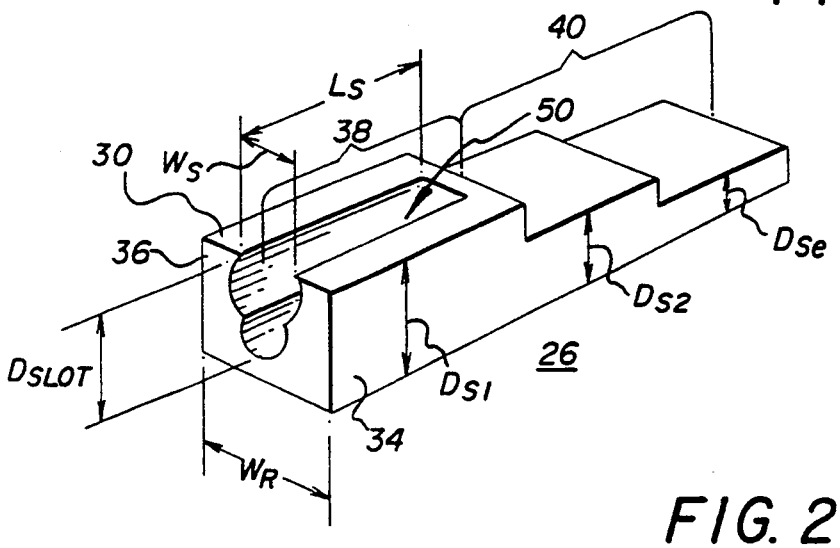
Figure 3A:
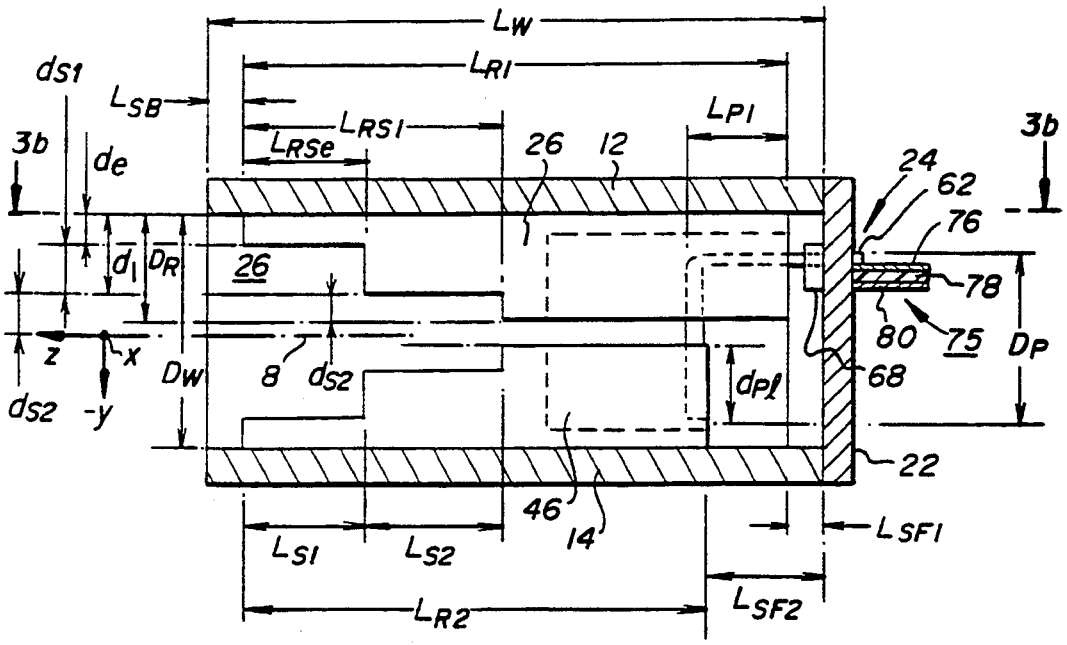
FIGS. 3*a* and 3*b* are side elevation and plan views, respectively, of an assembled version of an embodiment of the horn of FIG. 1, and FIG. 3*c*,is a side elevation view of a coupling probe.
Figure 3B:
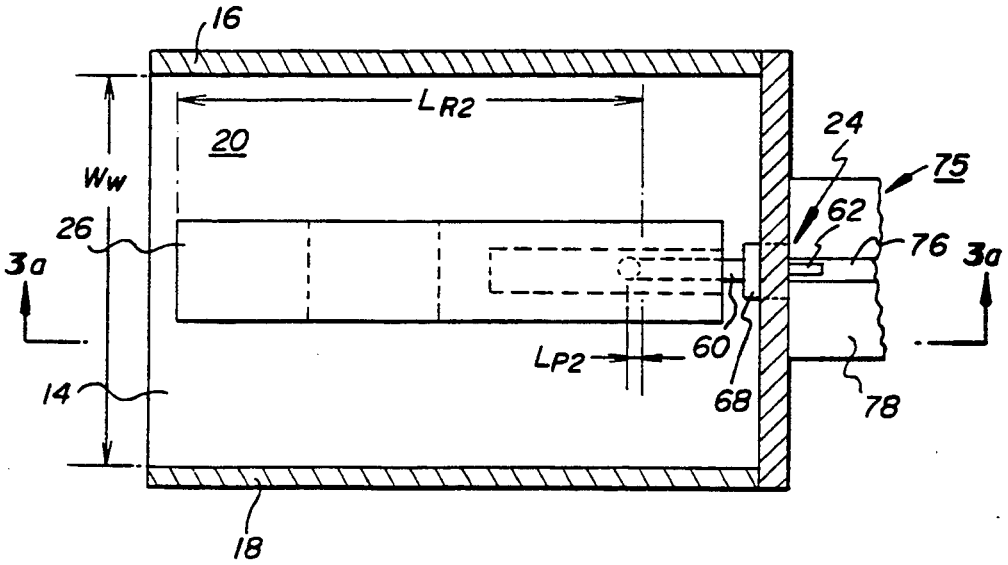

Referring to the exploded view of FIG. 1, and to FIGS. 2*a*, 2*b*, 3*a*, 3*b* and 3*c*, a horn antenna designated generally as 10 includes electrically conductive broad upper and lower walls 12 and 14, respectively, which are mutually parallel and spaced apart by the width of electrically conductive narrow walls 16 and 18, to define a rectangular waveguide coaxial with a longitudinal axis 8, and in which broad walls 12 and 14 are parallel to a first xz plane, and narrow walls 16 and 18 are parallel to a second yz plane. The near end of horn 10, at the left in FIGS. 1, 3*a* and 3*b*, defines an open radiating aperture 20, and the far end, at the right of FIGS. 1, 3*a* and 3*b*, is the feed end. A dielectric window, preferably of ceramic material, illustrated in dash lines as 19, is affixed over radiating aperture 20 to seal the aperture against ingress of unwanted material.

Those skilled in the antenna arts know that antennas are passive reciprocal devices, which have the same characteristics in both transmission and reception modes. For convenience, description of the operation is often couched in terms of either transmission or reception, with the other mode of operation being understood therefrom. Thus, the "radiating" aperture 20 is a receiving aperture in the receiving mode, and the "feed" end becomes a "load" end, or some equivalent term.

The feed end of horn 10, at the right of FIGS. 1, 3*a* and 3*b*, is closed off by a short-circuiting plate or wall 22, which in one embodiment of the invention is metallurgically joined to the feed-end edges of broad walls 12, 14 and narrow walls 16, 18. Short-circuiting wall 22 is parallel to the xy plane. An aperture 24 is defined in short-circuiting wall 22, to allow for passage of a feed conductor. As illustrated, aperture 24 is centered between narrow walls 16 and 18, but is closer to upper broad wall 12 than to lower broad wall 14.

Figure 2C:
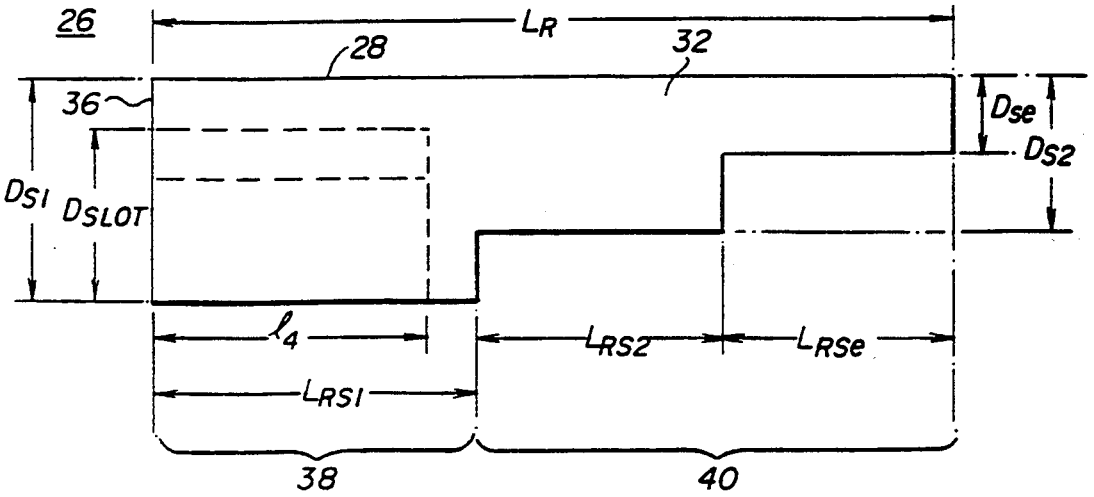
FIG. 2*c* is a side elevation view of the upper ridge of FIG. 2*a* and 2*b;*

An electrically conducting upper ridge 26 of FIG. 1, illustrated in detail in FIGS. 2*a*, 2*b* and 2*c*, defines a flat upper support surface 28, which in the fabricated unit is affixed to, or integral with, the inside surface of upper wall 12. Upper ridge 26 also defines a lower or opposed flat step or surface 30 of length $L_{RS1}$. Upper ridge 26 further defines a pair of side surfaces 32 and 34, and a feed-end surface 36. Feed-end surface 36 is parallel to the xy plane of FIG. 1, and is also orthogonal to support surface 28 and side surface 32. In a first step, portion or region 38 of upper ridge 26, the depth dimension of the ridge is designated $D_{S1}$. In a second portion or region 40, the depth dimension as measured from flat support surface 28 is less than dimension $D_{S1}$. As illustrated in FIGS. 1, 2*a*, 2*b* and 2*c*, region 40 of upper ridge 26 includes two further steps, namely a second step having length $L_R$ and depth $D_{S2}$, and a third or end step having length $L_R$ and depth $D_{SE}$. The overall dimension $L_R$ of ridge 26 is less than the interior length of horn 10 of FIG. 1, as measured from short-circuiting wall 22 to radiating aperture 20, so the ridge does not have to protrude beyond the aperture, and may be set back therefrom by a setback dimension $L_{SB}$. This is a distinct advantage over some prior-art arrangements in which the ridges protrude, because it allows use of simple flat dielectric aperture cover 19. The width $W_R$ of upper ridge 26 is the dimension between its sides 32 and 34.

Ridge 26 of FIGS. 1, 2*a*, 2*b*, 2*c*, 3*a* and 3*b* includes a "slot" 50 formed in its opposed surface 30, extending from feed-end surface 36, parallel to the yz plane and part-way through first portion 38. As illustrated in FIGS. 2*a* and 2*c*, the slot 50 is made in a convenient manner by drilling two holes from feed end surface 36, using a bit large enough, and located so as to break through opposed surface 30. The length of slot 50 is designated $L_S$, its width is designated $W_S$, and the depth is $D_{SLOT}$. A more conventional, parallel-sided slot may be used, if desired.

Lower waveguide ridge 46 of FIG. 1 is generally similar to upper ridge 26, except that its overall length may be somewhat less in a preferred embodiment, as described below.

Upper ridge 26 in FIG. 1 is affixed to the inside surface of upper broad wall 12 of horn 12, with its length dimension $L_R$ parallel to waveguide longitudinal axis 8, and centered between narrow walls 16 and 18, which is to say that support surface 28 of the upper ridge is bisected by the yz plane. Similarly, lower ridge 46 is mounted against the inside surface of lower broad wall 14, opposite to ridge 26. In a preferred embodiment of the invention, feed-end surface 36 of upper ridge 26 is spaced away from short-circuit wall 22 by a set-forward dimension $L_{SF1}$. The corresponding feed-end wall of lower ridge 46 is also spaced away from short-circuiting wall 22, although by a larger distance $L_{SF2}$.

Figure 3C:
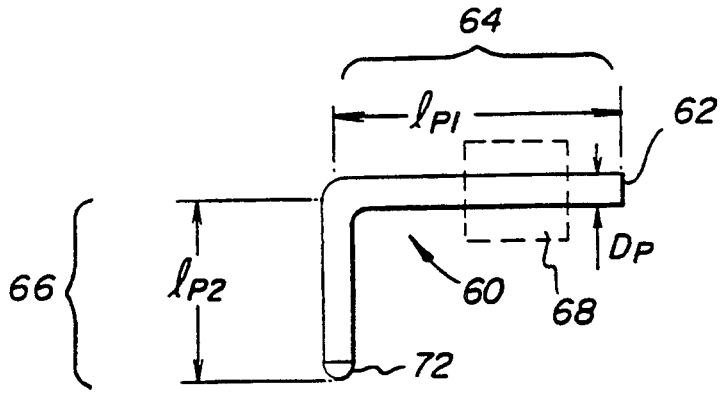

Referring once again to FIG. 1, and to FIGS. 3*a*, 3*b*, and 3*c*, an electrically conductive electric probe 60 is provided for feeding horn 10. Probe 60 includes a feed or support end 62 adapted to be coupled to the smaller conductor of an unbalanced transmission line, as for example the center or strip conductor 76 of a microstrip transmission line 75 including a dielectric substrate 78 and a larger ground conductor 80. Connection of a pin to a microstrip line in a waveguide context is described in U.S. Pat. No. 4,651,115, issued Mar. 17, 1987 in the name of Wu. Probe 60 includes a first portion 64 which extends parallel to longitudinal axis 8 from feed end 62 to an intermediate point 69, and which is partially surrounded by a dielectric support washer 68 which fits into feed aperture 24 in short-circuiting wall 22, to support probe 60 in its proper position. A second portion of probe 60 is designated 66. Portion 66 of probe 60 extends from intermediate point 69, at a 90° angle relative to portion 64, to thereby define a plane parallel to the yz plane. As described below, a part of probe 60 extends into slot 50 of upper ridge 26. It may be desirable to provide a flexible or elastic insulating sleeve, illustrated as 70, over that portion of probe 60 which lies within slot 50. For high-power applications, probe 60 may terminate in a hemisphere, illustrated as 72.

Figure 4:
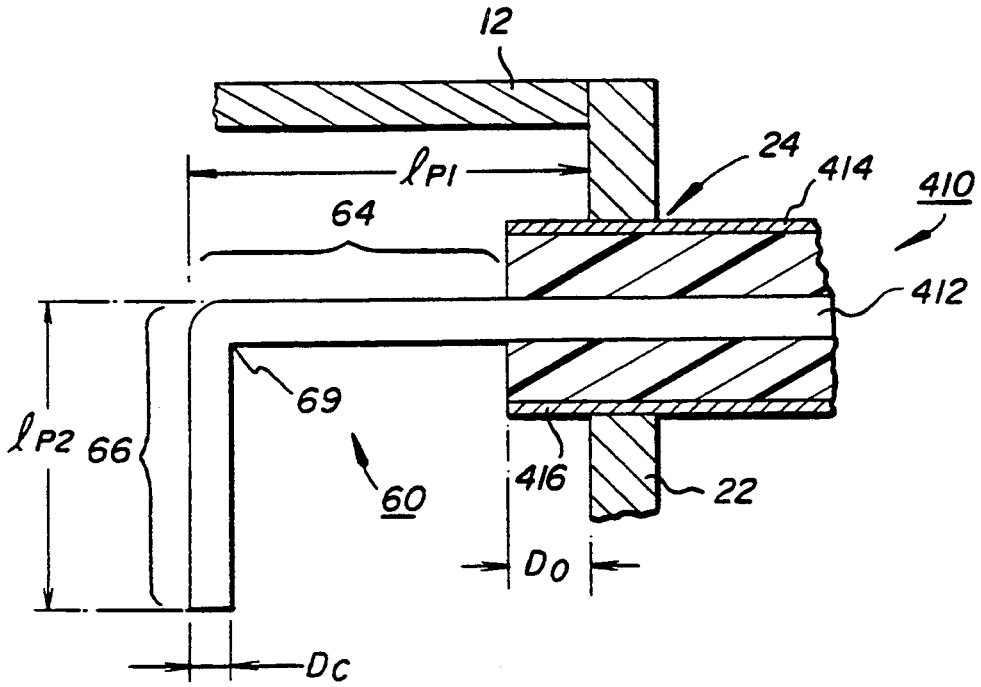
FIG. 4 is a partial side elevation view which illustrates details of a preferred embodiment of a probe and feed for the horn of FIGS. 3*a* and 3*b;*

A preferred embodiment of the invention uses the horn as described in conjunction with FIGS. 3*a* and 3*b*, with a coaxial feed as detailed in FIG. 4. In FIG. 4, elements corresponding to those of FIGS. 3*a* and 3*b* are designated by like reference numerals. In FIG. 4, upper broad wall 12 meets short-circuiting wall 22 adjacent circular aperture 24. A coaxial feed transmission line (coax), designated generally as 410, includes an inner conductor 412 and an outer conductor 414. Outer conductor 414 extends through short-circuiting wall 22, and protrudes within the horn by a distance $D_o$. Outer conductor 414 makes electrical contact with the periphery of aperture 24. Portion 64 of probe 60 is electrically connected to center conductor 412, and may actually be an extension of the center conductor. Portion 66 of probe 60 joins portion 64 at a bend or junction 69 of about 90°.

A preferred embodiment of the horn, designed for operation over an instantaneous frequency range of 3.00 GHz to 6.00 GHz, is as illustrated in FIGS. 3*a* and 3*b*, with the probe and feed arrangement of FIG. 4. Dimensions are tabulated in FIG. 8. As tabulated, upper ridge 26 is set forward from short-circuiting wall by a set-forward distance $L_{SF1}$ equal to 0.075 inch, and lower ridge 46 is set forward by $L_{SF2}$=0.175 inch. As detailed in FIGS. 3*a* and 3*b*, however, both upper and lower ridges 26, 46 are set back from radiating aperture 20 by $L_{SB}$=0.065 inch, and the step transitions in the ridges are coplanar. The depths $D_{S1}$ of the first step of the upper and lower ridges are each 0.200 inch, for a total ridge depth of 0.400 inch, which is 0.060 less than the waveguide interior depth $D_W$ of 0,460 inch.

Figure 5A:
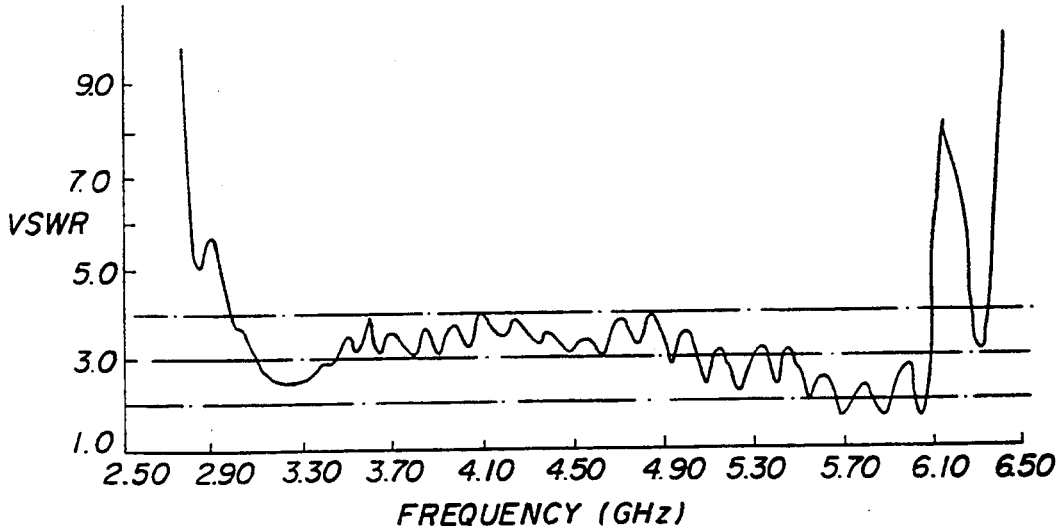
FIGS. 5*a* and 5*b* are plots of VSWR versus frequency for a horn according to the invention for different probe positions.
Figure 5B:
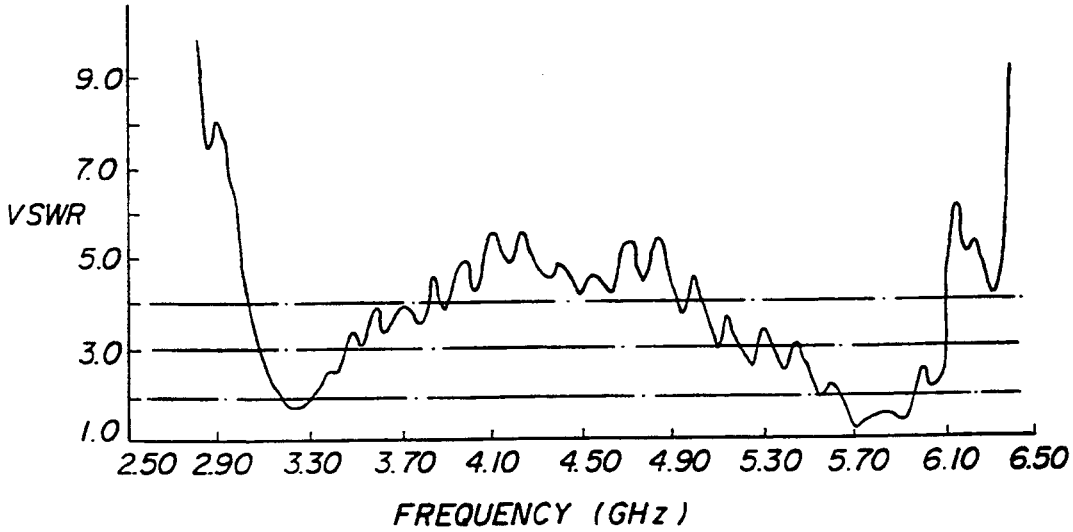

FIGS. 5*a* and 5*b* are plots of input VSWR vs. frequency of a 3 to 6 GHz horn as described in conjunction with FIGS. 3*a*, 3*b* and 4, and dimensioned according to FIG. 8, looking into the probe from a 50-ohm system, while the horn is radiating into a wideband H-plane simulator, as described in the article, *Simulation of Phased-Array Antenna in Waveguide*, by Hannan et al published at pp. 342–343 of *IEEE Transactions on Antennas and Propagation*, May 1965. The simulator simulates a scan angle of 29 degrees at 5.65 GHz and 50 degrees at 3.3 GHz. FIG. 5*a* shows the input VSWR for a probe position with dimension LSF2=0.344 inch, and FIG. 5*b* shows the input VSWR for a probe position with LSF2=0.324 inch, looking into the probe from a 50-ohm system. The performance in FIG. 5*b* has been simultaneously optimized at both the S radar band (3.1 to 3.5 GHz) and the C radar band (5.4 to 5.9 GHz) while allowing some degradation in between bands. The performance shown in FIGS. 5*a* and 5*b* includes the mismatch of the wideband H-plane simulator over the 3–6 GHz range.

Figure 6A:
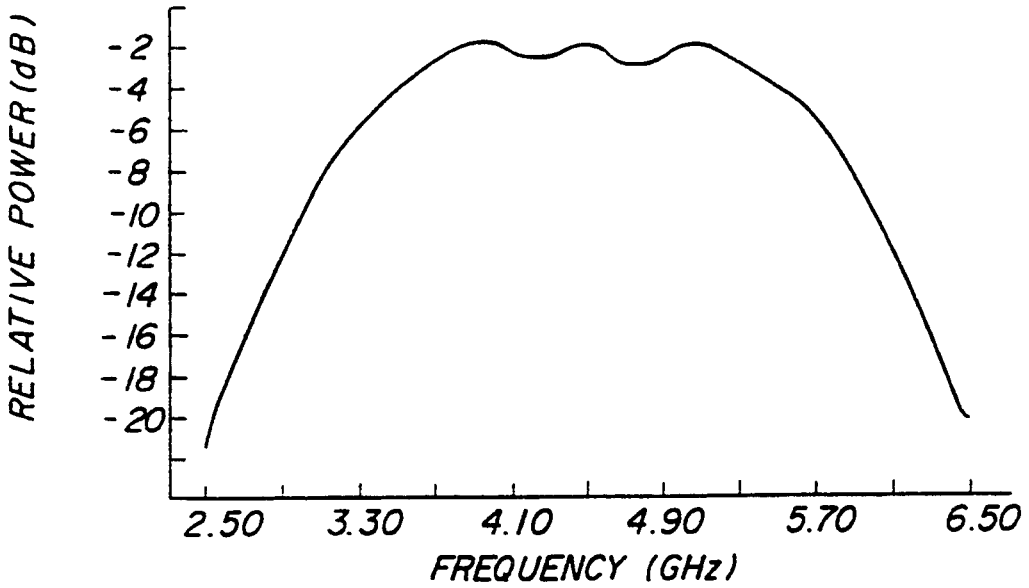
FIG. 6*a* and 6*b* are H-plane radiation patterns of a single horn in a simulated portion of an array.
Figure 6B:
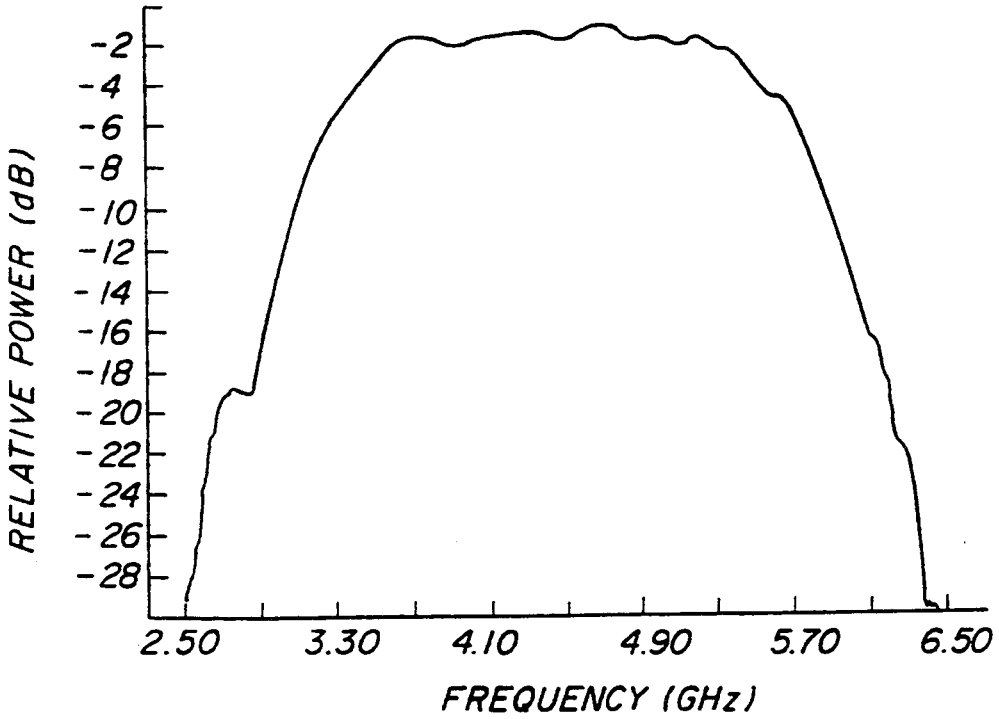

FIGS. 6*a* and 6*b* are H-plane plots of the radiation pattern of the 3–6 GHz horn, taken at 3.3 GHz and 5.65 GHz, respectively, in a small array of 13×13 horn elements.

The individual horn has been described so far. One of the advantages of the horn according to the invention is that, in addition to having satisfactory impedance and radiation pattern performance, it is physically short, namely 0.970 inches overall waveguide length for operation at 3 to 6 GHz, which is about 0.25 times the 3.9 inch wavelength at the lowest frequency of operation. This small longitudinal dimension makes it possible to manufacture an array by milling the horn array from a sheet or slab of metal with a nominal thickness of 1.125 inches.

Figure 7A:
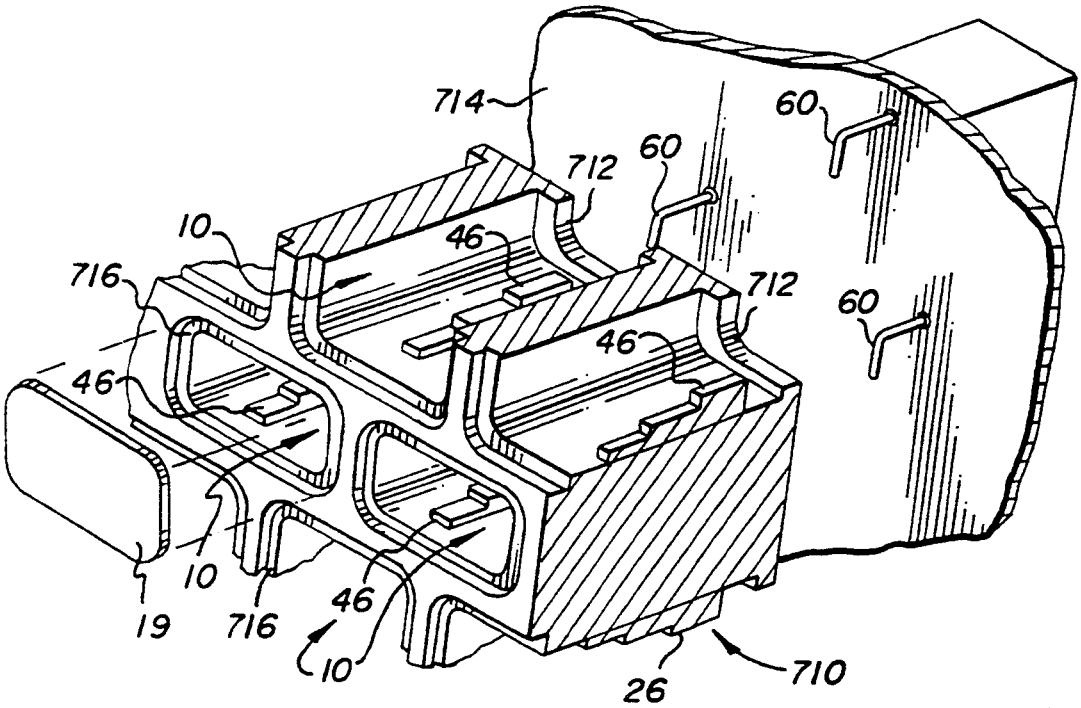
FIG. 7*a* is a perspective or isometric view of a portion of an array of horns according to the invention, together with a portion of removable rear wall and associated equipment, and adapted for manufacture by numerically controlled machines.

FIG. 7*a* is a perspective or isometric view of a portion of a horn array according to an aspect of the invention, cut away to reveal interior details. In FIG. 7*a*, a metal plate designated generally as 710 defines plural horns 10 milled therein, with the ridges 26 and 46 integral with the horn. A rear window or fenestration 712, smaller than the waveguide dimensions, is formed at the rear or feed end of each horn 10. A common short-circuiting wall 714 supports a plurality of probes 60 at locations such that, when wall 714 is translated toward and into contact with plate 710, the probes pass through rear apertures are located as detailed in FIGS. 3*a* and 3*b*. Electrical contact is made between each horn and shorting plate 714 by means of a springy conductive gasket (not illustrated), which is well known in the art. Sufficient screws are used applied to hold the gasket compressed.

In FIG. 7*a*, a single ceramic window 19 of a set of ceramic windows is illustrated. The windows are dimensioned to fit into a recess or flange 716 associated with a corresponding one of the horns 10, and may be held in place and sealed by an epoxy or silicone.

Figure 7B:
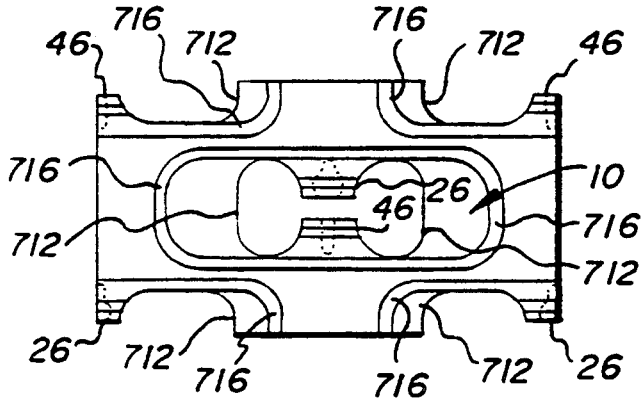
FIGS. 7*b* and 7*c* are front and rear elevation views of a portion of the horn array of FIG. 7*a.*
Figure 7C:
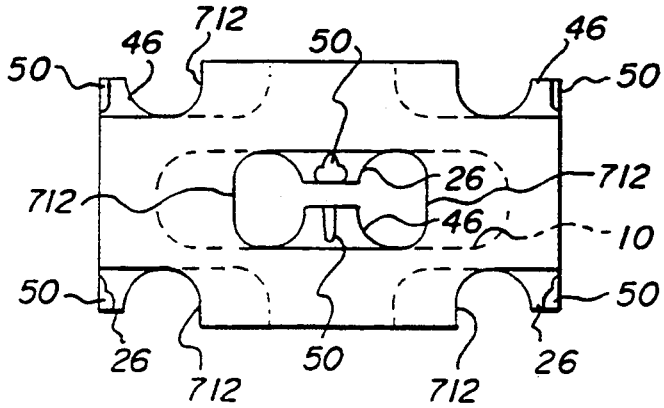

FIG. 7*b* is an elevation view of a portion of the array of FIGS. 7*a* as seen from the near (radiating) side in FIG. 7*a*, while FIG. 7*c* is a corresponding view from the reverse (shorting wall) side.

Those skilled in the art know that the dimensions listed in FIG. 8 may be scaled for operation at other octave (2:1) frequency bands, by proportioning the dimensions to the wavelength. For example, for operation over the frequency range of 6 to 12 GHz, the dimensions would be reduced to one-half the illustrated values.

Other embodiments of the invention will be apparent to those skilled in the art. For example, the ridges may be made separately from the walls and affixed thereto by soldering, brazing or welding, or the entire horn, or portions thereof including the ridges, may be fabricated as a monolithic unit, by casting or electroplating. While the first and second portions of probe 60 are illustrated as being at a 90° angle relative to each other, other angles may be used.

What is claimed is:

1. A horn antenna adapted to be fed from an unbalanced transmission line including a larger reference conductor spaced apart from a smaller conductor, said antenna comprising:

first and second mutually parallel, electrically conductive broad walls, spaced apart by first and second mutually parallel, electrically conductive narrow walls, together defining a rectangular waveguide centered about a longitudinal axis, and also defining first (yz) and second (xz) planes, each of which planes contains said longitudinal axis, said first plane (yz) being orthogonal to said first and second broad walls and parallel to said narrow walls, and said second (xz) plane being orthogonal to said first and second narrow walls and parallel to said broad walls, said waveguide including a rectangular radiating aperture at a radiating end of said waveguide and also including a feed end;

an electrically conductive short-circuiting wall at least electrically coupled to said first and second broad walls and to said first and second narrow walls at said feed end of said waveguide, said short-circuiting wall defining a feed aperture offset toward said first broad wall from said second (xz) plane, and centered between said first and second narrow walls;

a first electrically conductive waveguide ridge, said first waveguide ridge including a flat support surface and an opposed surface substantially parallel to said flat support surface, nominally mutually parallel side surfaces nominally orthogonal to said support and opposed surfaces, and also including a feed-end surface orthogonal to said side surfaces and to said support and opposed surfaces, said first waveguide ridge also having length ($L_R$), width ($W_R$) and depth dimensions, said length dimension ($L_R$) of said first waveguide ridge being equal to the length of said flat support surface of said first waveguide ridge and no greater than the distance between said radiating aperture and said short-circuiting wall, said width dimension ($W_R$) of said first waveguide ridge being measured between said side surfaces and being less than the width of said broad walls in a plane (xz) transverse to said longitudinal axis, and said depth dimension in a first portion of said first waveguide ridge, nearest to said feed-end surface of said first waveguide ridge, being constant as measured from said flat support surface to said opposed surface, which constant depth dimension is less than one-half the spacing between said broad walls, and said depth dimension, as measured from said flat support surface in a second portion of said first waveguide ridge remote from said feed-end surface, ranging from said constant depth dimension to a depth less than said constant depth dimension, said first waveguide ridge being mounted inside said rectangular waveguide with said flat support surface against, and supported by, said first broad wall, with said length dimension ($L_R$) of said first waveguide ridge parallel to said longitudinal axis of said rectangular waveguide, with said side surfaces symmetrically disposed about said first (yz) plane, and with said opposed surface nearest to and parallel with said second (xz) plane, said first ridge further defining a slot in its said opposed surface, which slot extends from said feed-end surface parallel to said first (xz) plane, and which has a slot width dimension ($W_S$) measured in a plane transverse to said longitudinal axis;

a second electrically conductive waveguide ridge, said second waveguide ridge including a flat support surface and an opposed surface substantially parallel to said flat support surface, nominally mutually parallel side surfaces nominally orthogonal to said support and opposed surfaces, and also including a feed-end surface orthogonal to said side surfaces and to said support and opposed surfaces, said second waveguide ridge also having length, width and depth dimensions, said length dimension of said second waveguide ridge being equal to the length of said flat support surface of said second waveguide ridge and no greater than the distance between said radiating aperture and said short-circuiting wall, said width dimension of said second waveguide ridge being measured between said side surfaces and being less than the width of said broad walls in a plane transverse to said longitudinal axis, and said depth dimension in a first portion of said waveguide ridge, nearest to said feed-end surface of said second waveguide ridge, being constant as measured from said flat support surface to said opposed surface, which constant depth dimension is less than one-half the spacing between said broad walls, and said depth dimension, as measured from said flat support surface in a second portion of said second waveguide ridge remote from said feed-end surface, ranging from said constant depth dimension to a depth less than said constant depth dimension, said second waveguide ridge being mounted inside said rectangular waveguide with said flat support surface against, and supported by, said second broad wall, and with said side surfaces symmetrically disposed about said first plane, with said length dimension of said second waveguide ridge parallel to said longitudinal axis of said rectangular waveguide, and with said opposed surface nearest to and parallel with said second plane, said second ridge further defining a slot in its said opposed surface, which slot extends from said feed-end surface parallel to said first plane, and which has a slot width dimension measured in a plane transverse to said longitudinal axis; and coupling means, said coupling means including an elongated probe defining support and second ends and an intermediate point therebetween, said probe being electrically isolated from, and mechanically supported at said support end by, said short-circuiting wall, said coupling means including means adapted for coupling (a) said support end of said probe to said smaller conductor of said transmission line and (b) said aperture of said short-circuiting wall to said reference conductor of said transmission line, said probe including a first portion, extending from said support end to said intermediate point, which extends parallel to said longitudinal axis of said rectangular waveguide into said slot of said first waveguide ridge in a manner electrically isolated from said first waveguide ridge, said probe also including a second portion, extending in said first plane (yz) at an angle relative to said first portion from said intermediate point to said second end of said probe, generally toward said second broad wall, in a manner which is electrically isolated from said second broad wall.

2. An antenna according to claim 1, wherein said second portion of said depth dimension of said first waveguide ridge includes a plurality of steps.

3. An antenna according to claim 1 wherein at least one of said length, width and depth dimensions of said first and second waveguide ridges are identical.

4. An antenna according to claim 1 wherein said coupling means includes hemispheric portion at said second end of said probe.

5. An antenna according to claim 1 further comprising dielectric insulating means surrounding at least a portion of said probe for aiding in maintaining electrical isolation.

6. An antenna according to claim 1 wherein said feed-end surface of at least one of said first and second waveguide ridges is spaced away from said short-circuiting wall.

7. An antenna according to claim 1, wherein said angle is 90°.

8. An antenna according to claim 1, wherein said first portion of said probe is straight.

9. An antenna according to claim 1, wherein said second portion of said probe is straight.

10. An antenna according to claim 1, wherein both said first and second portions of said probe are straight.

11. An antenna according to claim 1, wherein said second portion of said probe extends in said first plane toward said second ridge in a manner which is electrically isolated from said second ridge.

12. An antenna according to claim 1, wherein said second portion of said probe extends in said first plane toward and into said slot in said second ridge, in a manner which is electrically isolated from said second ridge.

* * * * *